United States Patent [19]

Glöckler et al.

[11] 4,449,508

[45] May 22, 1984

[54] ELECTRICALLY CONTROLLED OR REGULATED FUEL METERING SYSTEM FOR AN INTERNAL COMBUSTION ENGINE

[75] Inventors: Otto Glöckler, Renningen; Dieter Günther, Murr; Michael Horbelt, Schwieberdingen; Ulrich Steinbrenner, Stuttgart, all of Fed. Rep. of Germany

[73] Assignee: Robert Bosch GmbH, Stuttgart, Fed. Rep. of Germany

[21] Appl. No.: 416,995

[22] Filed: Sep. 13, 1982

[30] Foreign Application Priority Data

Oct. 8, 1981 [DE] Fed. Rep. of Germany ..... 3139988

[51] Int. Cl.[3] ..... F02B 3/00

[52] U.S. Cl. ..... 123/492; 123/494; 123/440

[58] Field of Search ..... 123/492, 440, 494

[56] References Cited

U.S. PATENT DOCUMENTS

| | | | |
|---|---|---|---|
| 4,107,920 | 8/1978 | Minami | 123/440 |
| 4,126,107 | 11/1978 | Harada | 123/492 |
| 4,158,347 | 6/1979 | Aoki | 123/440 |
| 4,170,201 | 10/1979 | Camp | 123/492 |
| 4,227,507 | 10/1980 | Takase | 123/492 |
| 4,246,383 | 12/1980 | Horbelt | 123/492 |
| 4,319,327 | 3/1982 | Higashiyama | 123/492 |

*Primary Examiner*—Ronald B. Cox

*Attorney, Agent, or Firm*—Edwin E. Greigg

[57] ABSTRACT

An electronically controlled or regulated fuel metering system for an internal combustion engine having one sensor each for the air flow in the intake tube and for the throttle valve position is proposed. In accordance with the signals of these sensors, influence can be exerted upon at least one of the operating states of lambda regulation, full load and fuel quantity limitation. The fundamental concept is that not only the air flow rate signal or only the signal relating to an opened throttle valve should be evaluated as a full-load signal but that the full-load state is presumed to exist when, with the throttle valve opened, the air throughput in the intake tube simultaneously exceeds a predetermined value as well. The same condition applies to full-load enrichment. The overall result is cleaner exhaust gas.

13 Claims, 4 Drawing Figures

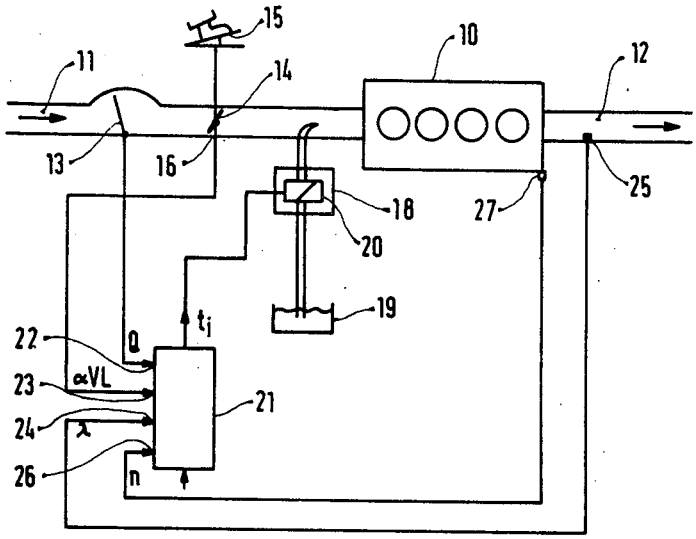
FIG. 1
FIG. 2a
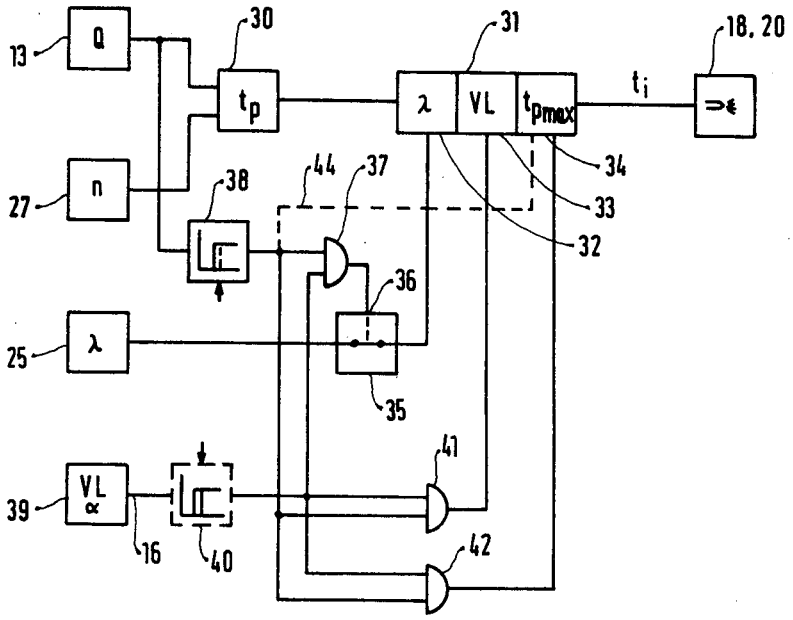

ELECTRICALLY CONTROLLED OR REGULATED FUEL METERING SYSTEM FOR AN INTERNAL COMBUSTION ENGINE

BACKGROUND OF THE INVENTION

In present-day fuel metering systems, efforts are made to adhere to the most precise possible stoichiometric fuel-air mixture because of both fuel consumption and exhaust emissions. However, the stoichiometric mixture has not proved to be efficacious over all the operating ranges of an engine. An example is full-load operation, in which the primary importance is to produce the maximum possible engine torque. If the fuel metering system includes a lambda regulating device having a lambda sensor in the exhaust tube, then the regulation system is generally shut off during full-load operation and a switchover is made to open-loop control of fuel metering. "Full-load operation" is, as a rule, defined by a throttle valve which is entirely, or virtually entirely, opened.

Depending upon the behavior of the driver of a vehicle equipped with such a fuel metering system for the engine, full-load operation may be signalled very frequently and the fuel metering system switched over from closed-loop to open-loop control. Over a relatively long period the intermittent enrichment of the mixture during the full-load phases results in unfavorable exhaust emissions.

OBJECT AND SUMMARY OF THE INVENTION

In the electronically controlled or regulated fuel metering system in accordance with the invention, it is assured that, in contrast to the prior art, the generation of a full-load signal no longer depends solely on the operator of the vehicle; instead, objective criteria play the predominant role in ascertaining the full-load state.

The invention will be better understood and further objects and advantages thereof will become more apparent from the ensuing detailed description of preferred embodiments taken in conjunction with the drawings.

BRIEF DESCRIPTION OF THE DRAWINGS

FIG. 1 is a generalized circuit diagram for an electronically controlled or regulated fuel metering system of an internal combustion engine;

FIG. *2a* and *2b* are block circuit diagrams for an injection system; and

Figure 3:
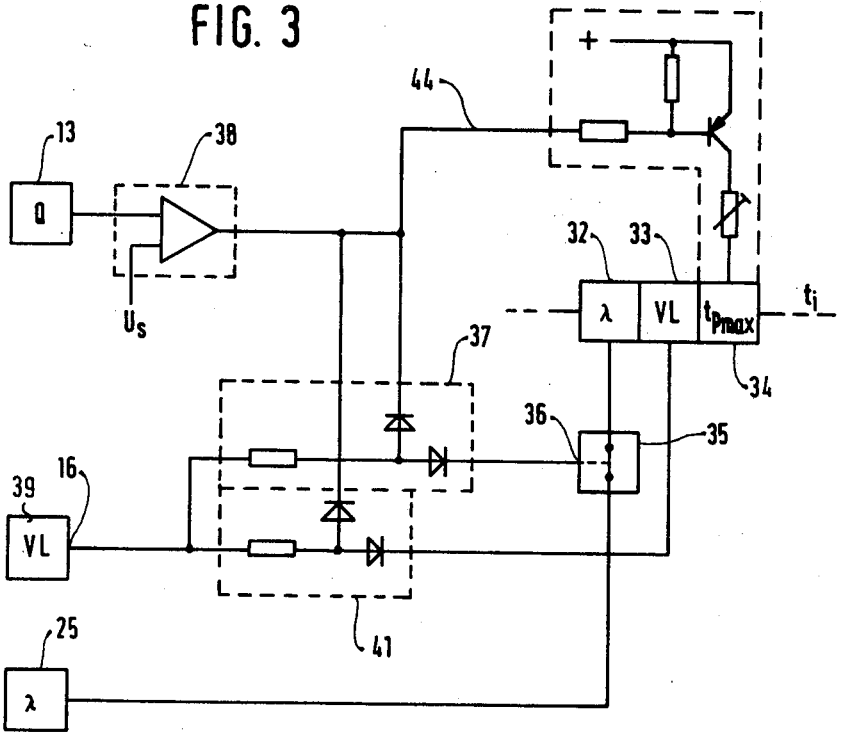

FIG. 3 is a circuit diagram for the portion of the subject of FIG. *2a* which is essential to the invention.

DESCRIPTION OF THE PREFERRED EMBODIMENTS

The following examples relate to fuel metering systems realized as fuel injection systems. However, the type of fuel metering system is of no significance in defining the invention.

In FIG. 1, a fuel injection system for an internal combustion engine 10 is shown in rough, schematic form. An air intake tube 11 leads to the engine 11 and is coupled with an exhaust gas tube 12. Disposed one behind the other in the air intake tube 11 are an air flow rate meter 13 and a throttle valve 14, the position of which is determined by a driving pedal 15 and which has a contact, not shown, for producing a signal when the throttle valve is fully opened. The corresponding signal may be picked up at an output 16. The injection system includes an injection valve 18, which is supplied with fuel from a tank 19 in accordance with the excitation of the inductive system 20, not further shown, of the magnetic valve 18. A control unit 21 provides the trigger signals for the magnetic valve 18. The control unit 21 has four inputs: one input 22 for an air flow rate signal, one input 23 for the signal relating to the fully opened throttle valve 14 from the output 16, one input 24 for a signal from a lambda sensor 25 in the exhaust tube 12 and finally one input 26 for an rpm signal from an rpm meter 27.

The fundamental structure of the subject illustrated in FIG. 1 is known. During the closed-loop control state of the fuel metering, the injection time of the magnetic valve 18 is determined on the basis of air throughput, rpm and lambda sensor signals. When the throttle valve is fully opened in the known fuel metering system, the closed-loop control is switched off; the fuel metering is switched over to open-loop operation, and the respective injection times are then determined in accordance with rpm. Naturally, further operating parameters such as the temperature may also be processed in the control unit 21.

FIG. *2a*, in the form of a block circuit diagram, shows the important components of the control unit 21 of FIG. 1. It includes a timing element 30, in which basic injection pulses of duration tp, which still remain to be corrected, are generated on the basis of output signals from the air flow rate meter 13 and the rpm meter 27. A subsequent correction circuit 31 enables the influencing of these basic injection pulses in accordance with signals from the lambda sensor, the throttle valve position transducer and a limitation circuit layout for the individual injection pulses. Corrected injection pulses of duration ti then proceed to the electromagnetic injection valve 18, 20. The correction circuit 31 is shown divided into three parts in FIG. *2a;* naturally, it is also possible for further variables to play a role in this process as well. The individual boxes shown in the three-part correction circuit 31 in the drawing contain symbols for the particular type of correction performed there. The individual correction circuit parts are numbered 32–34.

A switch 35 is located in the connecting line from the lambda sensor 25 to the correction stage part 32 for the lambda regulation. A control input 36 of this switch 35 is preceded by an AND gate 37. A threshold switch 38 receives the air flow rate signal from the air flow rate meter 13. A threshold switch 40 may likewise be disposed following a throttle valve position transducer 39, so long as the throttle valve position transducer ascertains any given position and not merely the fully opened position of the throttle valve. Finally, the two correction circuit parts 33 for full-load enrichment and 34 for the limitation of the injection quantity are preceded by respective AND gates 41 and 42. All three AND gates 37, 41 and 42 receive output signals from the threshold switch 38 and a signal relating to an opened throttle valve, either directly from the output 16 of the throttle valve switch or from the output of the threshold switch 40 which follows the throttle valve position transducer 39.

What is of the essence in the subject of FIG. *2a* is that the lambda regulation via the switch 35 is switched off only at such time as both of the following conditions pertain: the throttle valve is in its opened position, and the air flow rate meter indicates a predetermined full-load volume. The same applies to full-load enrichment; because of the given circuit configurations, full-load enrichment comes into effect only when both the throttle valve and the air flow rate meter indicate a high load status. Finally, an altered maximal limitation for the injection quantity at a given time is brought about by way of the AND gate 42, in accordance with whether full-load operation is actually in effect or not. If the normally very rapid limitation of the injection quantity were allowed to be made under all operating conditions and if no switchover were made, then in the case of rapid acceleration, the overswing of the valve (where there is a flap-type air flow rate meter) and the attendant enrichment of the mixture would not become effective. However, the switchover to a higher $t_{pmax}$ value assures good acceleration.

Also shown in FIG. 2*a*, in dashed lines, is a separate intervention line 44 leading from the output of the threshold switch 38 to the correction circuit part 34 for the limitation of the fuel quantity. This line 44 clearly indicates that this limitation can also be switched over solely in response to the output signal of the air flow rate meter 13.

Figure 2B:
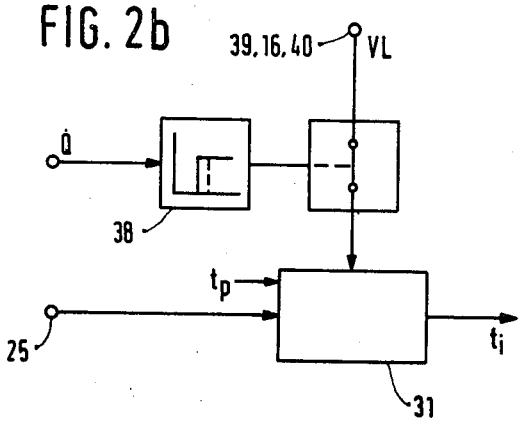

While the lambda sensor signal is used as is in the subject of FIG. 2*a*, FIG. 2*b* shows a variant version in which influence can be exerted on the evaluation of the sensor signal. The full-load signal (VL) here passes via a switch dependent on air throughput to a VL control input of the lambda regulating part of the correction circuit 31 and influences its output signal ti.

With the above-discussed logical linkages of the individual signals for full-load determination, it has also been found that in the driving cycle prescribed for the United States exhaust emissions test, with its extremely short acceleration phases, the lambda regulation remains continuously switched on, and thus an optimal exhaust gas is attained.

One exemplary embodiment of the most important elements of FIG. 2 is shown in FIG. 3, with identical reference numerals. However, deviating from the subject of FIG. 2, the switchover to $t_{pmax}$ in the circuit layout of FIG. 3 is selected solely in accordance with the occurrence of high air throughput in the intake tube, so that the AND gate 42 is omitted yet the connecting line 44 comes into effect. This switchover to $t_{pmax}$ is realized, in the subject of FIG. 3, by means of a controllable current source, which is associated with the corresponding correction circuit part 34. The two AND gates 37 and 41 are made up of diode-resistor combinations. It is again important in the subject of FIG. 3 that the full-load enrichment is effected, and the fuel metering is switched from closed-loop to open-loop control, not only when the throttle valve is fully opened but when the air throughput in the intake tube also exceeds a predetermined value.

It has also been found efficacious for the threshold values of the threshold switches 38 and/or 40 to be dependent on operating parameters (such as temperatures).

For some types of internal combustion engine, threshold switches which operate with hysteresis have also proved to be advantageous.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. In an electronically controlled fuel metering system for controlling control variables upon the instance of a full-load condition for an internal combustion engine having one sensor means each for the air flow in an intake tube of said engine and for the position of a throttle valve of said engine, comprising a signal generating means for generating a full-load signal in accordance with a logical linkage of signals from said sensor means for said air flow and said throttle valve position.

2. A fuel metering system as defined by claim 1, wherein said signal generating means includes an influencing means for lambda regulation, full-load enrichment and fuel quantity limitation responsive to a high air flow rate and an opened throttle valve, whereby the fuel quantity limitation becomes effective at a later time than normal and a full-load enrichment is provided.

3. A fuel metering system as defined by claim 1, wherein said signal generating means includes an influencing means for lambda regulation, full-load enrichment and fuel quantity limitation responsive to a high air flow rate and an opened throttle valve, whereby the lambda regulation is switched off, and a switchover to open-loop control of fuel metering is effected.

4. A fuel metering system as defined by claim 2, further comprising a threshold switch means for detecting said high air-flow rate signal.

5. A fuel metering system according to claim 3, further comprising a threshold switch means for detecting said high air-flow rate signal.

6. A fuel metering system as defined by claim 1, wherein said signal generating means includes an influencing means for lambda regulation, full-load enrichment and fuel quantity limitation responsive to a flow rate signal indicating an opened throttle valve, whereby the fuel quantity limitation is selected to be small and the full-load enrichment is switched off.

7. A fuel metering system as defined by claim 1, further comprising a threshold switch means for receiving said position signal of said throttle valve.

8. A fuel metering system as defined by claim 4, wherein said threshold switch means is dependent on operating parameters for threshold values.

9. A fuel metering system as defined by claim 5, wherein said threshold switch means is dependent on operating parameters for threshold values.

10. A fuel meterng system as defined by claim 7, wherein said threshold switch means is dependent on operating parameters for threshold values.

11. A fuel metering system as defined by claim 4, wherein said threshold switch means operates with hysteresis.

12. A fuel metering system as defined by claim 5, wherein said threshold switch means operates with hysteresis.

13. A fuel metering system as defined by claim 7, wherein said threshold switch means operates with hysteresis.

* * * * *